US005079133A

United States Patent [19]

Mitsui et al.

[11] Patent Number: 5,079,133

[45] Date of Patent: Jan. 7, 1992

[54] SILVER HALIDE COLOR PHOTOGRAPHIC MATERIAL

[75] Inventors: Akio Mitsui; Takashi Ozawa, both of Kanagawa, Japan

[73] Assignee: Fuji Photo Film Co., Ltd., Kanagawa, Japan

[21] Appl. No.: 554,981

[22] Filed: Jul. 16, 1990

Related U.S. Application Data

[63] Continuation of Ser. No. 275,615, Nov. 25, 1988, abandoned, which is a continuation of Ser. No. 37,917, Apr. 13, 1987, abandoned.

[30] Foreign Application Priority Data

Apr. 11, 1986 [JP] Japan ..... 61-83675

[51] Int. Cl.[5] ..... G03C 7/30; G03C 7/38

[52] U.S. Cl. ..... 430/372; 430/469; 430/551

[58] Field of Search ..... 430/551, 558 R, 469, 430/372

[56] References Cited

U.S. PATENT DOCUMENTS

| | | | |
|---|---|---|---|
| 2,091,713 | 8/1937 | Mannes et al. | 430/469 |
| 2,728,659 | 12/1955 | Loria et al. | 430/551 |
| 3,201,242 | 8/1965 | Schwann et al. | 430/469 |
| 3,982,944 | 9/1976 | Ohi et al. | 430/551 |
| 4,121,939 | 10/1978 | Adachi et al. | 430/551 |
| 4,500,630 | 2/1985 | Sato et al. | 430/558 |
| 4,540,654 | 9/1985 | Sato et al. | 430/558 |
| 4,588,679 | 5/1986 | Furutachi | 430/551 |
| 4,607,002 | 8/1986 | Nakayama et al. | 430/558 |
| 4,618,573 | 10/1986 | Okamura et al. | 430/558 |
| 4,675,275 | 6/1987 | Nishijima et al. | 430/558 |
| 4,735,893 | 4/1988 | Morigaki et al. | 430/551 |
| 4,906,559 | 3/1990 | Nishijima et al. | 430/551 |

*Primary Examiner*—Richard L. Schilling
*Attorney, Agent, or Firm*—Sughrue, Mion, Zinn Macpeak & Seas

[57] ABSTRACT

A silver halide color photographic material is provided that contains at least one pyrazoloazole type coupler represented by formula (I)

(I)

wherein Za and Zb each represents or =N—, $R_1$ and $R_2$ each represents a hydrogen atom, a halogen atom, an alkyl group, an aryl group, a heterocyclic group, a cyano group, an alkoxy group, an aryloxy group, a heterocyclic hydroxyl group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group, and X represents a hydrogen atom or a group cleavable in a coupling reaction with an oxidized aromatic primary amine developing agent, and in the case where Za=Zb is a carbon-carbon double bond, the double bond may form part of a condensed aromatic ring, and which pyrazoloazole type coupler may form a dimer or a more higher polymer via $R_1$, $R_2$ or X; and at least one of compounds having the following formula (II)

(II)

wherein $R_3$ and $R_4$ each represents a hydrogen atom or a straight or branched alkyl group containing from 1 to 10 carbon atoms, provided that the sum of the numbers of carbon atoms of $R_3$ and $R_4$ is from 4 to 11.

8 Claims, No Drawings

SILVER HALIDE COLOR PHOTOGRAPHIC MATERIAL

This is a continuation of application Ser. No. 07/275,615, filed Nov. 25, 1988, now abandoned, which is a continuation of application Ser. No. 07/037,917, filed Apr. 13, 1987, now abandoned.

FIELD OF THE INVENTION

The present invention relates to silver halide color photographic materials, and more particularly silver halide color photographic materials that are excellent in color reproducibility, less produce undesired stain, and is excellent in dye stability.

BACKGROUND OF THE INVENTION

Generally, silver halide color photographic materials have silver halide emulsion layers that are sensitive to the three primary colors, blue, green, and red, and they develop yellow, magenta, and cyan colors, respectively, thereby reproducing dye images by using the so-called subtractive color process. Therefore, the dye image that is reproduced is largely dependent on the color sensitivity of the layers and the spectral absorption properties of the developed colors.

Generally, these properties have not necessarily been as good as theoretically desired, because of restrictions with respect to color developability, etc., of the compounds that are used. Particularly, various improvements in the developed hue of magenta couplers, which is important in view of color reproduction, have been made. Among others, pyrazoloazole type magenta couplers are excellent in spectral absorption property of the developed hue.

For example, to improve the developed hue of magenta couplers, in the 5-pyrazolone type, anilino type magenta couplers more excellent in spectral absorption property than the ureido type and the acylamino type have been developed (see Japanese Patent Application (OPI) Nos. 74027/74 and 111631/74, etc., (the term "OPI" as used herein refers to a "published unexamined Japanese patent application"). Pyrazoloazole type magenta couplers that are low in undesired subabsorption have also been developed (see U.S. Pat. No. 3,725,067, etc.). In comparison to the colored images obtained from 5-pyrazolone type magenta couplers, the images obtained from this type of coupler are excellent in that undesired absorption in the blue light zone and the red light zone is less, which is favorable from the point of view of color reproduction, and yellowing is less probably because the coupler itself is stable to light, heat, and humidity, and hardly decomposes. On the other hand, in comparison to 5-pyrazolone type magenta couplers, the pyrazoloazole type magenta couplers have the drawback that when developed, the reaction of the oxidized product of the developing agent formed in the treating liquid with the couplers is apt to produce undesired magenta stain. This stain is conspicuous when the color developing bath contains a silver halide solvent such as a thioether.

To obviate the color fog that would tend to be formed by a color developing solution, several methods have been hitherto suggested.

It is said there are roughly three types of fog that are formed by a color developing bath. The first type of fog is due to the silver halide emulsion(s), the second type of fog is caused during storage from the formation of the photographic material to the developing treatment, and the third type of fog is due to couplers, which develop colors indiscriminately with the oxidized product of a developing agent that is present in a small amount in the developing solution. To prevent these types of fog, it is known to use, for example, compounds having a mercapto group and tetraazaindenes, which is disclosed in U.S. Pat. Nos. 3,954,474, 3,982,947 and 4,021,248, Japanese Patent Publication No. 28660/77, *Research Disclosure*, RD No. 17643, etc.

On the other hand, to prevent color fog, it is known that hydroquinone derivatives are effective. For example, with respect to di-branched alkylhydroquinones, reference can be made to U.S. Pat. Nos. 3,700,453 and 2,732,300, with respect to di-linear alkylhydroquinones, reference can be made to U.S. Pat. Nos. 2,728,659 and 2,732,300, with respect to mono-branched alkylhydroquinones, reference can be made to U.S. Pat. No. 3,700,453, with reference to mono-linear alkylhydroquinones, reference can be made to U.S. Pat. No. 2,728,659, and with respect to other hydroquinone derivatives, reference can be made to U.S. Pat. Nos. 2,360,290, 2,701,197, 2,336,327, 2,403,721, 3,582,333, etc.

However, it has been found that although compounds having a mercapto group or tetraazaindenes can reduce fog somewhat, they are not effective enough against color fog, and although hydroquinone derivatives that are conventionally used are very effective in reducing color fog, they damage the dye stability of pyrazoloazole type couplers against light.

SUMMARY OF THE INVENTION

Therefore, the object of the present invention is to provide silver halide color photographic materials that use the excellence of pyrazoloazole type magenta couplers and are improved in long-term storability.

More particularly, a first object of the present invention is to provide silver halide color photographic materials excellent in color reproducibility by the use of a magenta dye image having good spectral absorption properties.

A second object of the present invention is to provide color photographic materials that can produce stable dye images and can reduce white area stains.

A third object of the present invention is to provide color photographic materials that will not substantially result in undesired color fog when color development is effected.

Other objects of the present invention will become apparent from the following description.

The inventors have studied intensively to develop silver halide color photographic materials that can attain the above objects and have found that the above objects can be accomplished by incorporating a pyrazoloazole type magenta coupler together with a specified hydroquinone derivative in a silver halide color photographic material. That is, the inventors have found that only hydroquinone derivatives whose alkyl chain length is restricted can suppress color fog enough without adversely affecting the stability against light. The invention has been made based on the finding.

Therefore, the present invention has been accomplished by providing a silver halide color photographic material comprising at least one pyrazoloazole type coupler represented by formula (I)

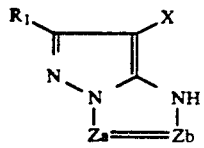

(I)

wherein Za and Zb each represents

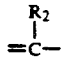

or =N—, $R_1$ and $R_2$ each represents a hydrogen atom, a halogen atom, an alkyl group, an aryl group, a heterocyclic group, a cyano group, an alkoxy group, an aryloxy group, a heterocyclic hydroxyl group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group, with an alkyl group, an alkoxy group, an alkylthio group, an aryl group, an aryloxy group, an arylthio group, an acylamino group, and an anilino group being preferred, and X represents a hydrogen atom or a group cleavable in a coupling reaction with an oxidized aromatic primary amine developing agent, and in the case where Za=Zb is a carbon-carbon double bond, the double bond may form part of a condensed aromatic ring, and which pyrazoloazole type coupler may form a dimer or a higher polymer via $R_1$, $R_2$, or X; and at least one compound having the following general formula (II)

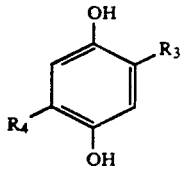

(II)

wherein $R_3$ and $R_4$ each represents a hydrogen atom or a linear or branched alkyl group containing from 1 to 10 carbon atoms, provided that the sum of the numbers of carbon atoms of $R_3$ and $R_4$ is from 4 to 11.

Of the pyrazoloazole type magenta couplers represented by formula (I), preferred are those represented by the following formulae (Ia), (Ib), (Ic), (Id), and (Ie).

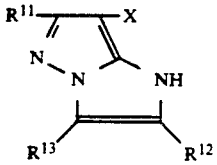

(Ia)

-continued

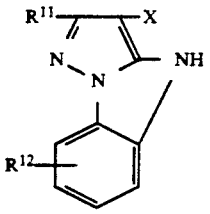

(Ib)

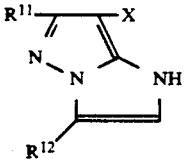

(Ic)

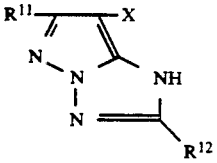

(Id)

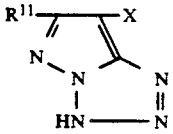

(Ie)

Of the couplers represented by formulae (Ia) to (Ie), those represented by formulae (Ic) and (Id) are preferred for the purpose of the present invention.

In formulae (Ia) to (Ie), $R^{11}$, $R^{12}$, and $R^{13}$ (which may be the same or different) each represents a hydrogen atom, a halogen atom, an alkyl group, an aryl group, a heterocyclic group, a cyano group, an alkoxy group, an aryloxy group, a heterocyclic hydroxyl group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group, with an alkyl group, an alkoxy group, an alkylthio group, an aryl group, an aryloxy group, an arylthio group, an acylamino group, and an anilino group being preferred. X represents a hydrogen atom, a halogen atom, a carboxyl group, or a group that is joined to the carbon atom at the coupling position via an oxygen atom, a nitrogen atom, or a sulfur atom, and is cleavable when coupling occurs. $R^{11}$, $R^{12}$, $R^{13}$ or X may be a divalent group forming a bis form compound.

Polymeric couplers where coupler groups represented by one or more of formulae (Ia) to (Ie) are present in the main chain or side chain of the polymer are also possible, and polymers derived from vinyl monomers having a moiety represented by formula (I) are preferred, where $R^{11}$, $R^{12}$, $R^{13}$ or X represents a vinyl group or other linking group.

More particularly, $R^{11}$, $R^{12}$, and $R^{13}$ each represents a hydrogen atom, a halogen atom (e.g., a chlorine atom, a fluorine atom, etc.), an alkyl group (e.g., a methyl group, a propyl group, a t-butyl group, a trifluoromethyl group, a tridecyl group, a 3-(2,4-di-t-amylphenoxy)propyl group, an aryl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-amylphenoxy)-butyramido group, a γ-(3-t-butyl-4-hydroxyphenoxy)-butyramido group, an α-[4-(4-hydroxyphenylsulfonyl)-phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-t-butyl-4-hydroxyphenoxy)-dodecanamido]anilino group, etc.), a ureido group (e.g., a phenylureido group, a methylureido group, an N,N-dibutylureido group, etc.), an imino group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N,N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecylcarbonyl group, an octadecylcarbonyl group, etc.), or an aryloxycarbonyl group (e.g., a phenyloxycarbonyl group, a 3-pentadecyloxycarbonyl group, etc.), and X represents a hydrogen atom, a halogen atom (e.g., a chlorine atom, a bromine atom, an iodine atom, etc.), a carboxy group, a group that links through an oxygen atom (e.g., an acetoxy group, a propanoyloxy group, a benzoyloxy group, a 2,4-dichlorobenzoyloxy group, an ethoxyoxazoyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group that will link through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.), an arylazo group (e.g., a 4-methoxyphenylazo group, a 4-pivaloylaminophenylazo group, a 2-naphthylazo group, a 3-methyl-4-hydroxyphenylazo group, etc.), or a group that will link through a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When a compound represented by formulae (Ia), (Ib), (Ic), (Id), and (Ie) is included in a vinyl monomer, the linking group represented by $R^{11}$, $R^{12}$, $R^{13}$ or X includes a group formed by combining groups selected from alkylene groups (e.g., a substituted or unsubstituted alkylene group such as a methylene group, an ethylene group, a 1,10-decylene group, $—CH_2CH_2OCH_2CH_2—$, etc.), substituted or unsubstituted phenylene groups (e.g., a 1,4-phenylene group, a 1,3-phenylene group,

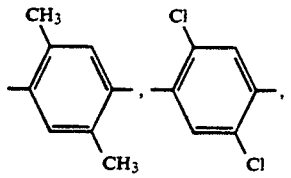

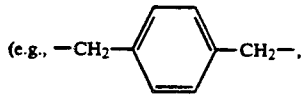

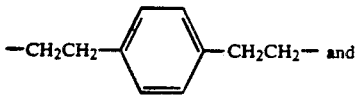

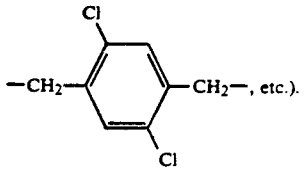

Preferred linking groups are —NHCO—, —$CH_2CH_2$—,

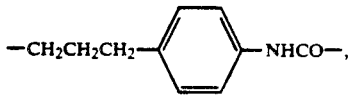

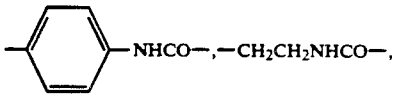

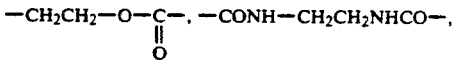

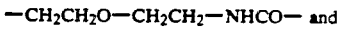

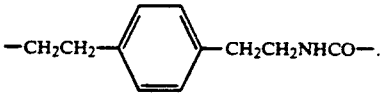

In addition to those represented by formulae (Ia) to (Ie), a vinyl group forming part of the polymeric coupler may have another substituent, and preferred substituents include a hydrogen atom, a chlorine atom or a lower alkyl group containing from 1 to 4 carbon atoms (e.g., a methyl group or an ethyl group).

Monomers including those represented by formulae (Ia) to (Ie) may form a copolymer with a non-color developing ethylenic monomer that will not couple with the oxidation product of an aromatic primary amine developing agent.

As is well known in the field of polymer color couplers, the non-color developing ethylenically unsaturated monomer to be copolymerized with a solid water-insoluble monomer coupler can be selected such that the physical properties and/or the chemical properties of the copolymer such as the solubility, the compatibility with the binding material of the photographic colloid composition such as gelatin, the flexibility, the heat stability, etc., may be favorably affected.

The polymeric couplers used in the present invention may be soluble or insoluble in water, and of these, polymeric coupler latexes are preferred.

Of pyrazoloazole type magenta couplers represented by formula (I), preferable are those represented by formulae (If), (Ig), (Ih) and (Ii).

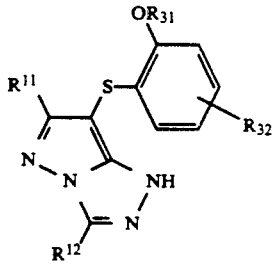

(If)

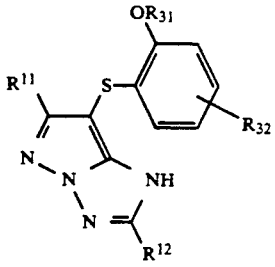

(Ig)

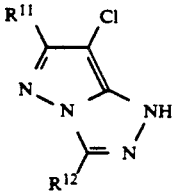

(Ih)

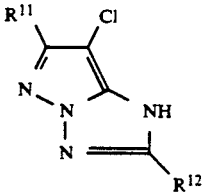

(Ii)

In formulae (If) and (Ig), $R_{31}$ represents an alkyl group, and $R_{32}$ represents an alkoxy group or an alkylthio group. More particularly, examples thereof include an alkyl group (e.g., an ethyl group, a t-butyl group, a t-octyl group, a 3-(2,4-di-t-amylphenoxy)propyl group, an aryl group, a 2-dodecyloxyethyl group, a 3-phenoxypropyl group, a cyclopentyl group, a benzyl group, etc.), an alkoxy group (e.g., a methoxy group, a 2-methoxyethoxy group, an octyloxy group, a 2-methanesulfonylethoxy group, etc.), and an alkylthio group (e.g., a methylthio group, an octylthio group, a tetradecylthio group, a 2-phenoxyethylthio group, etc.).

$R^{11}$ and $R^{12}$ in formulae (If) to (Ii) each has the same meaning as those in formula (I), and preferably represents an alkyl group, an alkoxy group, an alkylthio group, an aryl group, an aryloxy group, an arylthio group, an acylamino group, or an anilino group.

More preferably, in formulae (If) to (Ii), $R^{11}$ represents an alkyl group having from 3 to 16 carbon atoms (e.g., a propyl group, a t-octyl group, a 2-ethylhexyl group, etc.), an alkoxy group having 1 to 16 carbon atoms (e.g., an ethoxy group, a 2-methoxybutoxy group, an n-octyloxy group, a 2-methanesulfonylethoxy group, etc.), or an alkylthio group (e.g., a methylthio group, a t-octylthio group, a tetradecylthio group, a 2-phenoxybutylthio group, etc.).

Examples of typical magenta couplers and vinyl monomers therefor used in the present invention are set forth below, but such is not intended to restrict the present invention.

M-1

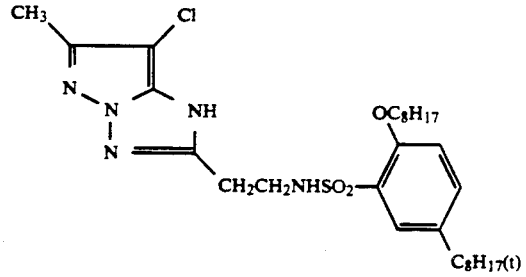

M-2

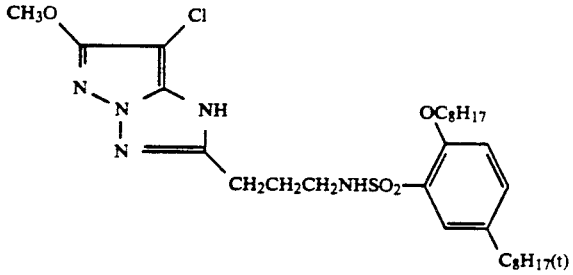

M-3

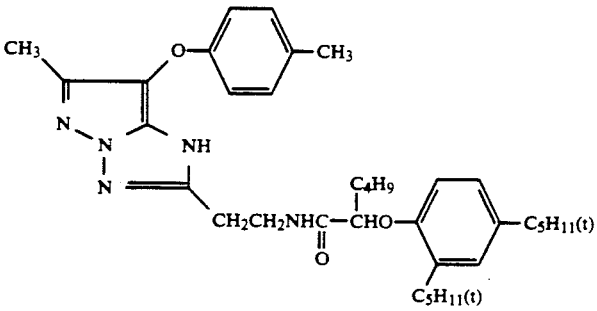

M-4

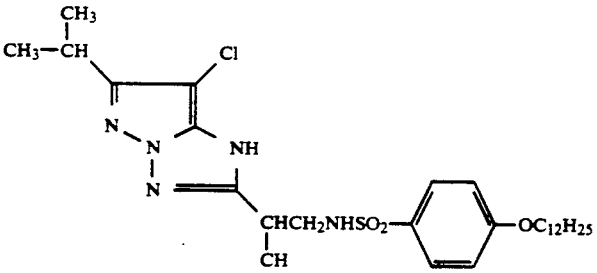

M-5

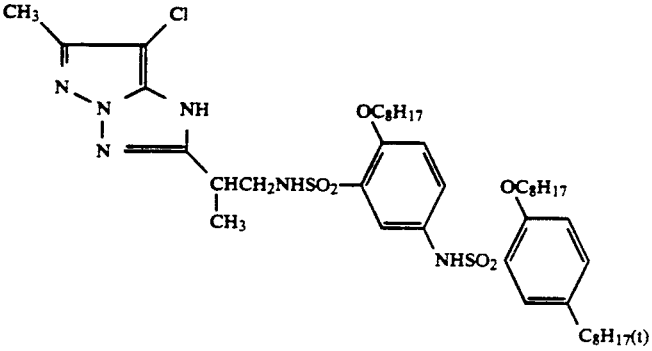

-continued
M-6
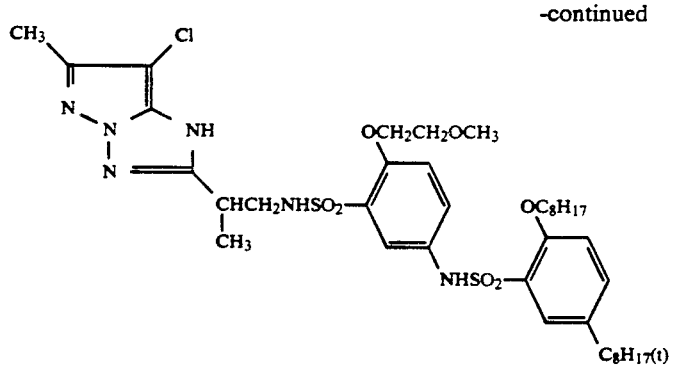
M-7
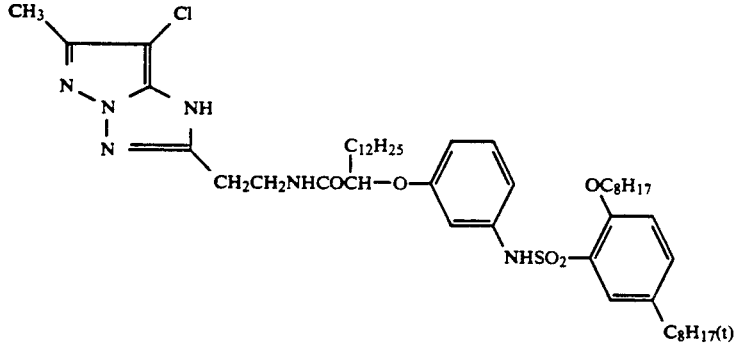
M-8
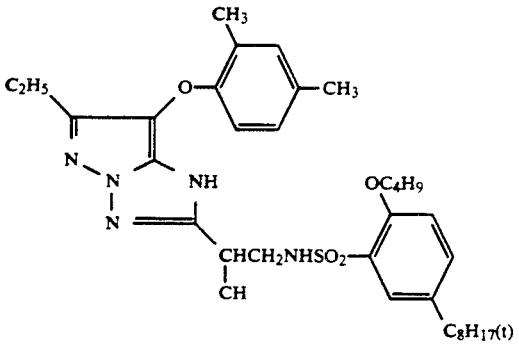
M-9
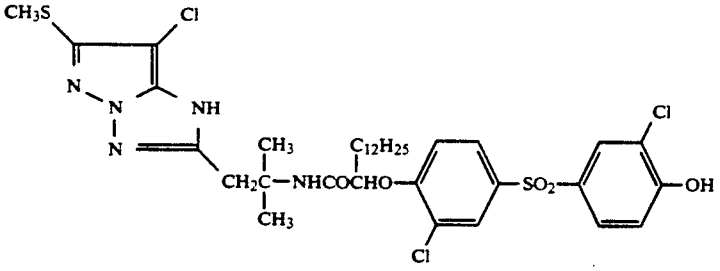
M-10
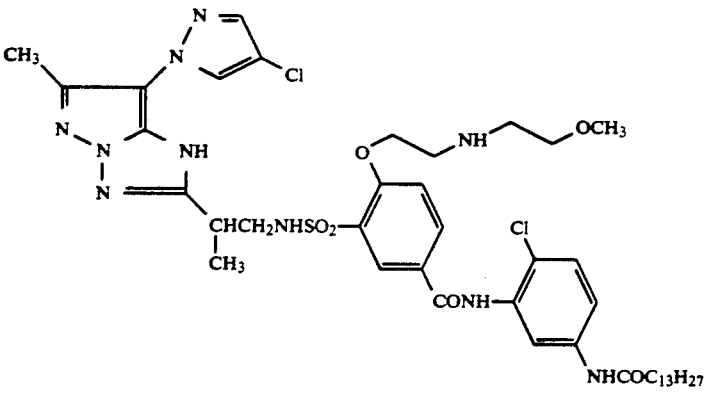

-continued
M-11
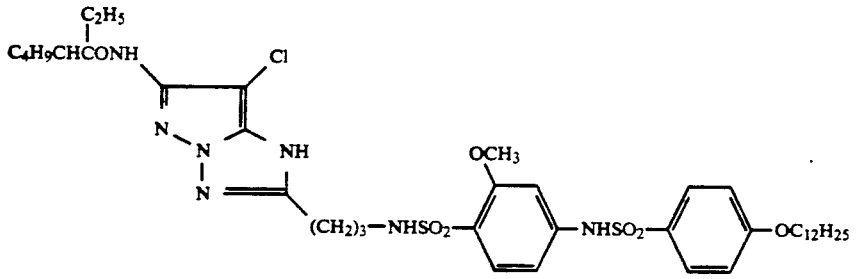
M-12
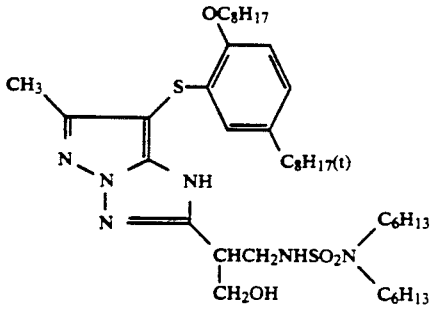
M-13
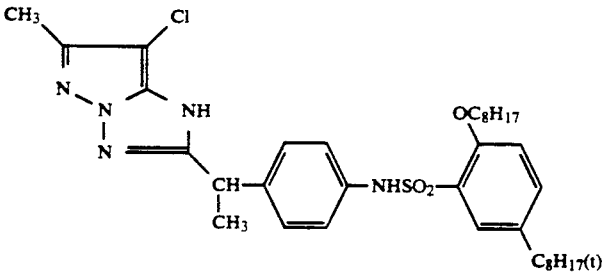
M-14
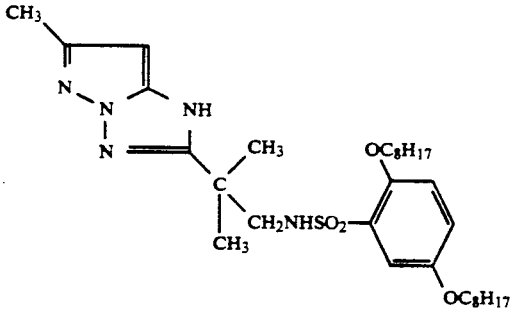
M-15
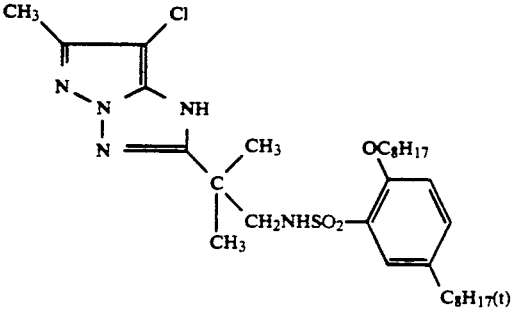

-continued
M-16
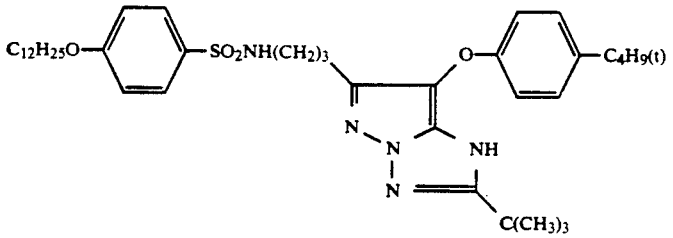
M-17
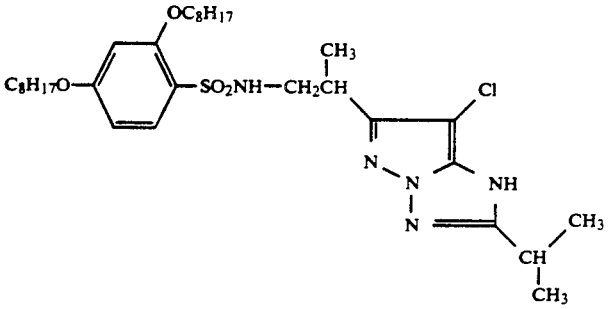
M-18
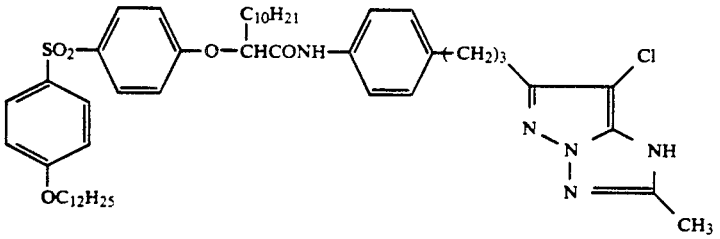
M-19
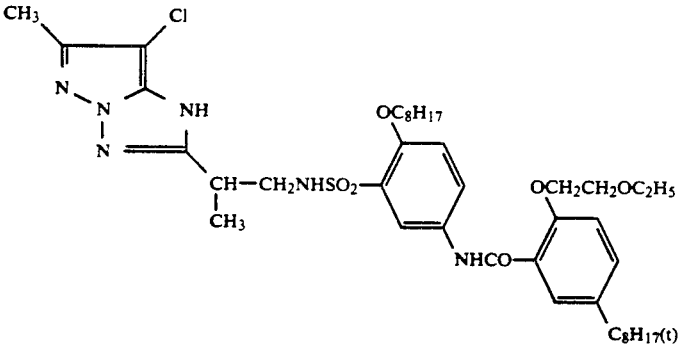
M-20
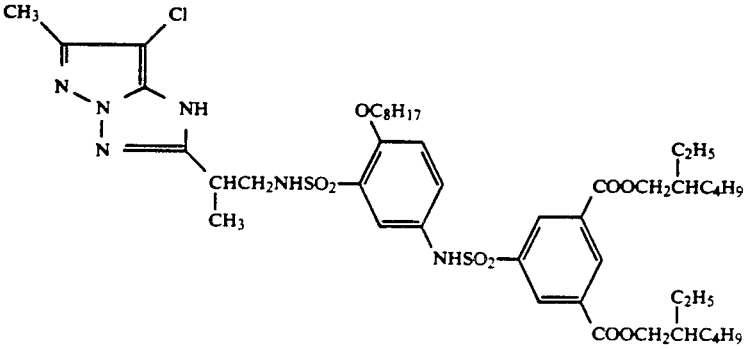

-continued
M-21
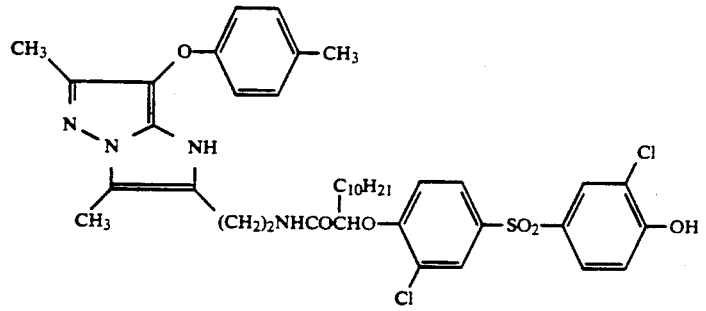
M-22
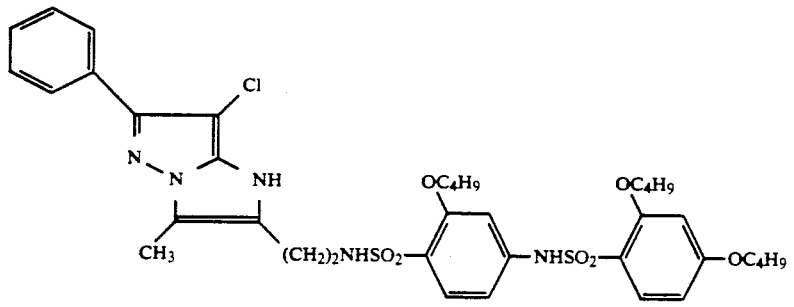
M-23
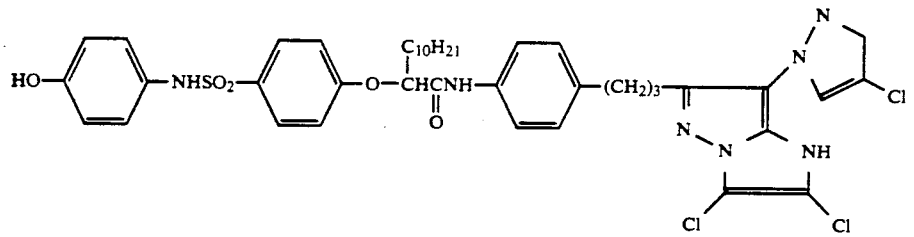
M-24
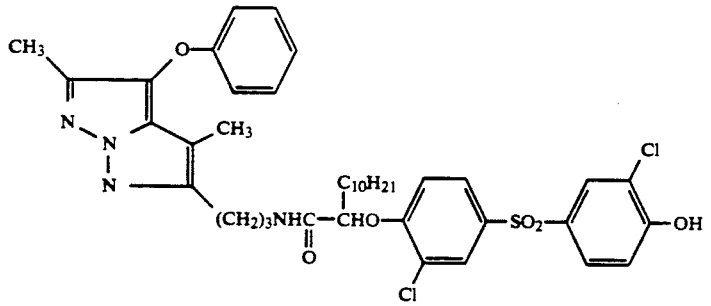
M-25
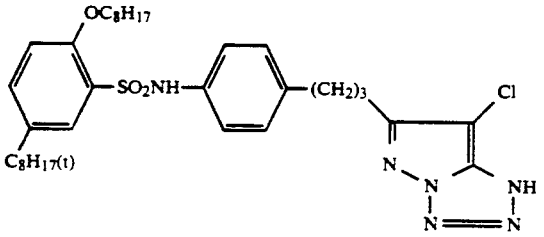

-continued
M-26
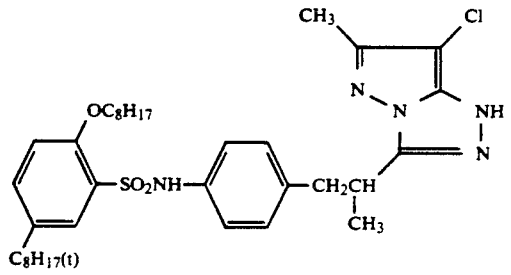
M-27
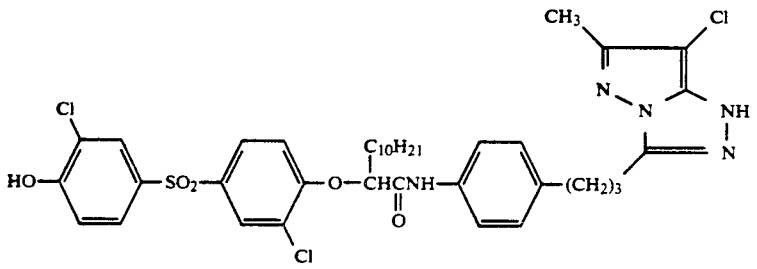
M-28
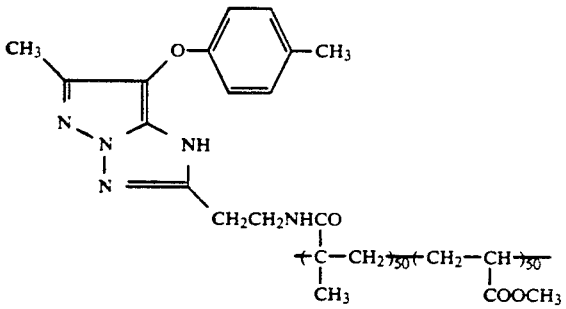
M-29
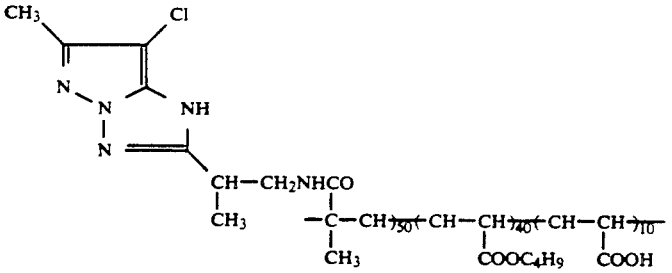
M-30
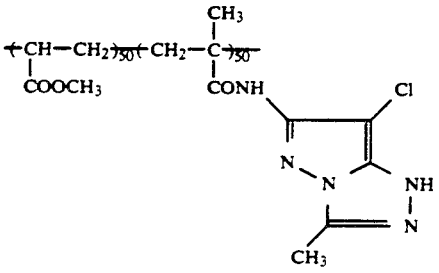

-continued
M-31
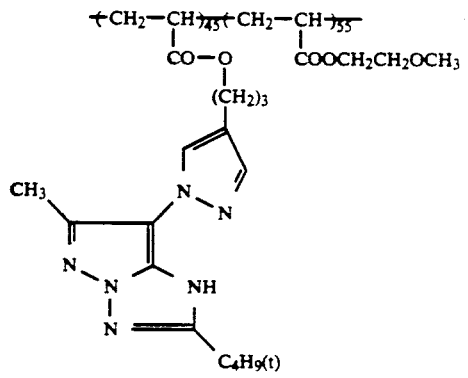
M-32
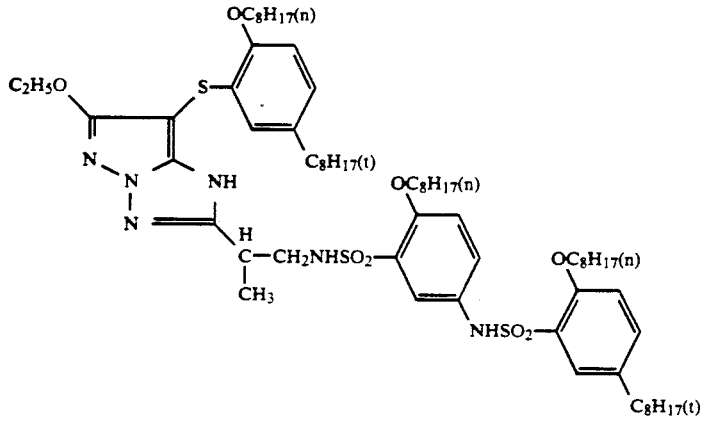
M-33
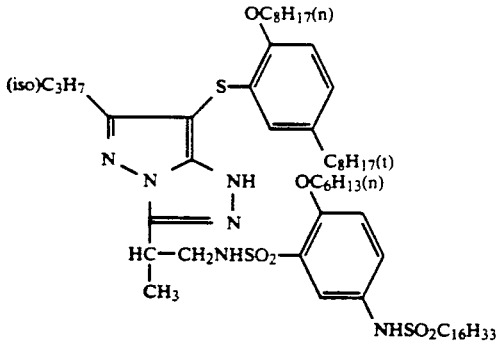
M-34
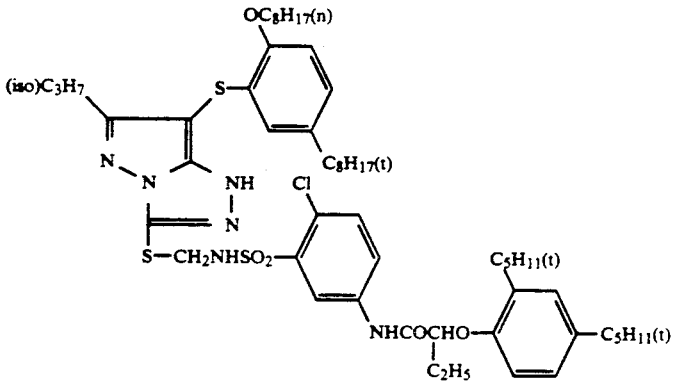

-continued
M-35
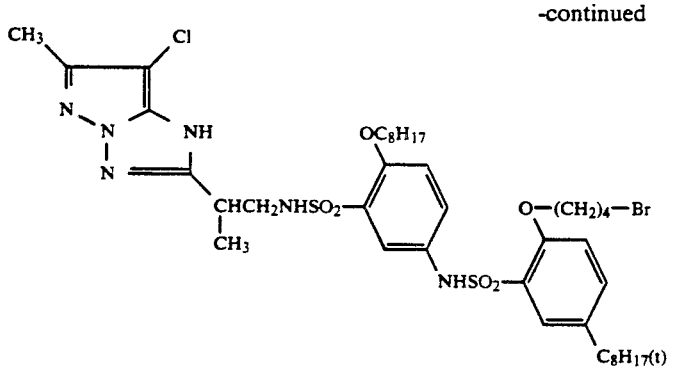
M-36
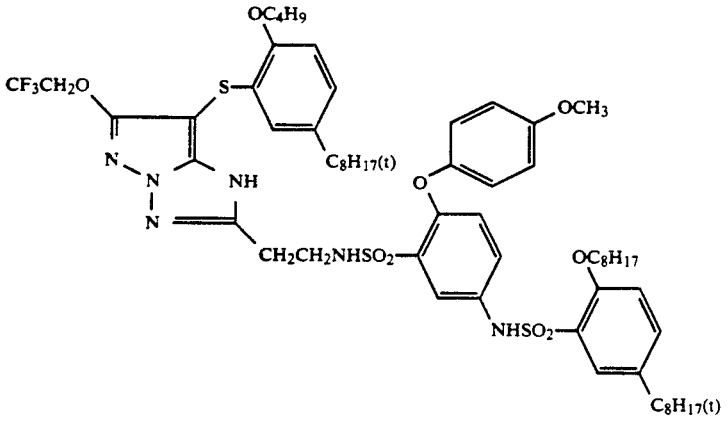
M-37
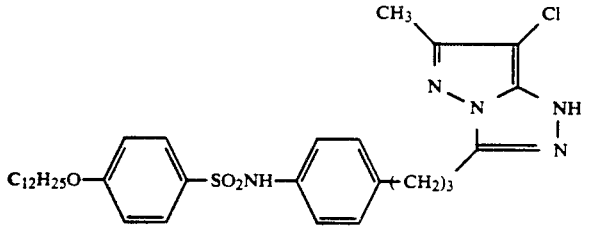
M-38
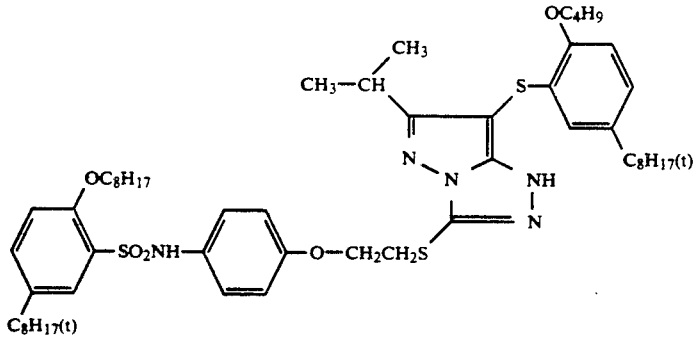
M-39
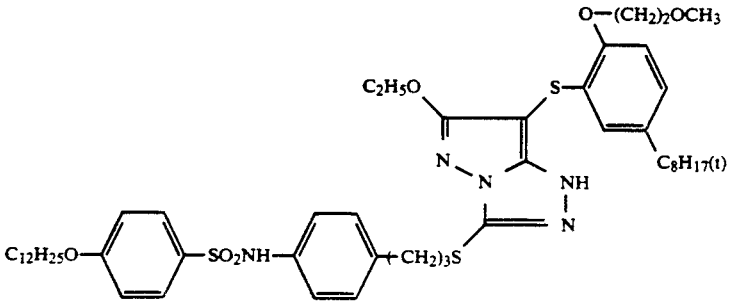

-continued

M-40

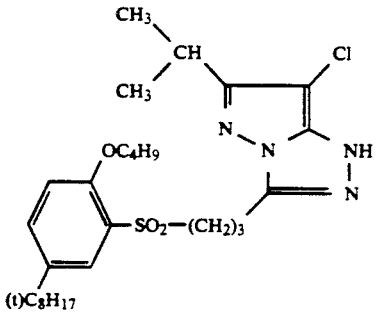

M-41

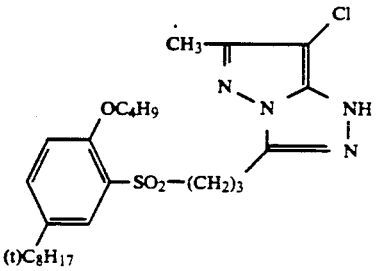

Examples of the coupler compounds represented by formulae (Ia) to (Ie) described above and methods of synthesizing them are described in the following publications, etc.

Compounds of formula (Ia) are described in Japanese Patent Application (OPI) No. 162548/84, compounds of formula (Ib) are described in Japanese Patent Application (OPI) No. 171956/84, compounds of formula (Ic) are described in Japanese Patent Application (OPI) No. 33552/85, compounds of formula (Id) are described in U.S. Pat. No. 3,061,432, and compounds of formula (Ie) are described in U.S. Pat. No. 3,725,067.

Highly color developing ballast groups as described, e.g., in Japanese Patent Application (OPI) Nos. 42045/83, 177553/84, 174836/84, 177554/84, 177557/84, 177556/84 and 177555/84, etc., can be applied to any one of the compounds of the above formulae (Ia) to (Ie).

Examples of compounds included in formula (II) therefor in the present invention are set forth below, but again such is not intended to restrict the present invention.

(II-1)

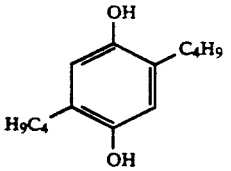

(II-2)

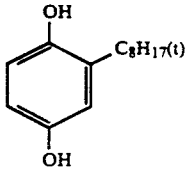

-continued (II-3)

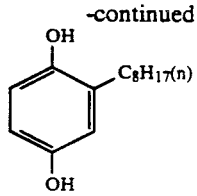

(II-4)

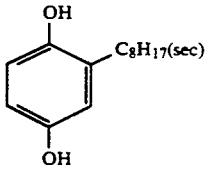

(II-5)

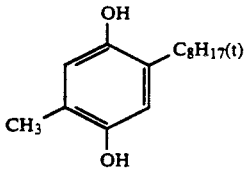

(II-6)

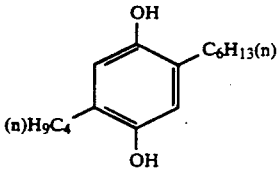

(II-7)

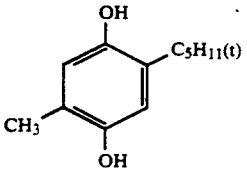

-continued (II-8)

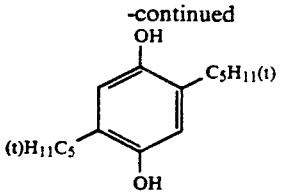

(II-9)

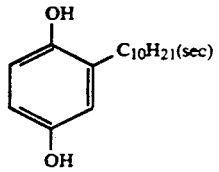

(II-10)

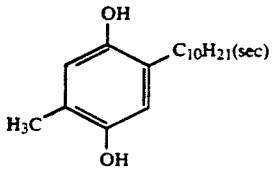

The above compounds can be synthesized by the methods described in U.S. Pat. No. 2,728,659, Japanese Patent Application (OPI) No. 106329/74, U.S. Pat. No. 3,700,453, Japanese Patent Application (OPI) No. 146235/77, etc., and the methods cited in those publications.

Although the magenta coupler represented by formula (I) may be used in any layer in a photosensitive material, preferably it is used in a green-sensitive layer. The amount used is preferably from 0.01 g/m$^2$ to 1.0 g/m$^2$, and more preferably from 0.05 g/m$^2$ to 0.7 g/m$^2$.

A combination of two or more pyrazoloazole type magenta couplers or a combination of a pyrazoloazole type magenta coupler and a 3-pyrazolo type magenta coupler can be used. The molar ratio of silver halide (in a silver halide emulsion) to a coupler in the pyrazoloazole type coupler-containing layer is preferably from 0.1/1 to 10/1 and more preferably from 0.5/1 to 6/1. Desirably, the pyrazoloazole type coupler is used with a high boiling point organic solvent, and the weight ratio of the solvent to coupler is preferably up to 8/1, and more preferably from 0.2/1 to 2/1.

It is desirable that the compound represented by formula (II) is contained in the same layer in which the pyrazoloazole type coupler is contained. Preferably the amount thereof is from 0.1 mol % to 100 mol %, and more preferably from 1 mol % to 10 mol % with respect to the coupler.

For the photosensitive material according to the present invention, it is particularly desirable that the color developing solution in the developing process contains a water-soluble rhodan salt or an organic thioether compound. Particularly preferred examples of water-soluble salts to be contained in the developing bath are the following.

(III-1): KSCN
(III-2): NaSCN
(III-3): $NH_4S$

Of organic thioether compounds to be contained in the developing bath, particularly preferred are compounds represented by formulae (IVa) to (IVc).

$$HO\text{-}(R_{41}-S)_n-R_{41}OH \quad \text{(IVa)}$$

-continued $$(HO-R_{41}-SR_{41}-OR_{42})_2O \quad \text{(IVb)}$$

(IVc)

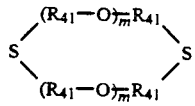

wherein m and n each is an integer of 1 to 3, and $R_{41}$ and $R_{42}$ each represents an alkylene group containing from 1 to 5 carbon atoms (e.g., a methylene group, an ethylene group, $$-CH_2-\underset{CH_3}{\underset{|}{CH}}-,\ -CH_2-\overset{CH_3}{\underset{CH_3}{\overset{|}{\underset{|}{C}}}}-,$$

a butylene group, etc.).

Of compounds represented by formula (IV), particularly preferably $R_{41}$ represents $-CH_2CH_2-$.

(IV-1):
$HOCH_2CH_2SCH_2CH_2SCH_2CH_2OH$ (IV-2):

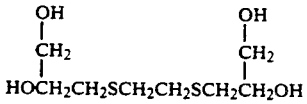

(IV-3):
$HOCH_2CH_2SCH_2CH_2OCH_2CH_2OCH_2CH_2OCH_2CH_2SCH_2CH_2OH$ (IV-4):

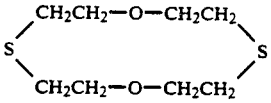

(IV-5):
$HOCH_2CH_2SCH_2CH_2OH$ (IV-6):
$HOCH_2CH_2SCH_2CH_2SCH_2CH_2SCH_2CH_2OH$ (IV-7):
$HOCH_2CH_2CH_2CH_2SCH_2CH_2CH_2CH_2OH$

Preferably, the amount of the water-soluble rhodan salt or the organic thioether compound in the developing bath is from 3.0 g/liter to 0.01 g/liter, and more preferably is from 2.0 g/liter to 0.05 g/liter.

In the photographic emulsion layer of the photographic material used in the present invention, any silver halide of silver bromide, silver bromoiodide, silver bromochloroiodide, silver chlorobromide and silver chloride can be used. A preferred silver halide is silver bromoiodide or silver bromochloroiodide containing up to about 30 mol % of silver iodide. The content of silver chloride therein is from 0 mol % to 100 mol %.

The silver halide grains in the photographic emulsion may be regular crystals, which are the so-called regular grains, such as cubes, octahedrons or tetradecahedrons, irregular crystals such as spheres, crystals having crystal defects such as twin planes or composite forms of these. A mixture of grains having various crystal forms can be used.

Fine grains whose silver halide grain diameter is up to about 0.1 micron, and large-sized grains whose projected area is about 10 microns may be used, and a monodispersed emulsion whose distribution is narrow and a polydispersed emulsion whose distribution is broad may be used.

The silver halide photographic emulsions that can be used in the present invention can be produced in known manner, for example, by the methods described in "J. Emulsion Preparation and Types", *Research Disclosure*, RD No. 17643 (December, 1978), pages 22-23, and *Research Disclosure*, RD No. 18716 (November, 1979), page 648.

The photographic emulsions used in the present invention may be prepared by the methods described by P. Glafkides in *Chimie et Physique Photographique*, Paul Montel (1967); by G. F. Duffin in *Photographic Emulsion Chemistry*, Focal Press (1966); by V. L. Zelikman et al., *Making and Coating Photographic Emulsion*, Focal Press (1964), etc. That is, any one of the acid method, the neutral method, the ammonia method, etc., can be used, and to react a soluble silver salt with a soluble halide, the single jet method and the double jet method and a combination of these can be used. A method where grains are formed in the presence of an excess of silver ions, which method is the so-called reverse mixing method, can be used. As one type of the double jet method, a method can be used wherein the pAg in the liquid phase where a silver halide is to be produced is kept constant, which method is the so-called controlled double jet method. According to this method, a silver halide emulsion where the crystal forms are regular and the grain size is uniform can be obtained.

Physical ripening can be carried out in the presence of a known silver halide solvent (e.g., ammonia, potassium rhodan, thioethers and thione compounds described in U.S. Pat. No. 3,271,157, Japanese Patent Application (OPI) Nos. 112360/76, 82408/78, 144319/78, 00717/79 and 155828/79). According to this method, a silver halide emulsion where the crystal forms are regular and the grain size is uniform can be also obtained.

A silver halide emulsion comprising regular grains can be obtained by controlling the pAg and the pH during the formation of the grains. Details may be described, for example, in *Photographic Science and Engineering*, Vol. 6, pages 159-165 (1962), *Journal of Photographic Science*, Vol. 12, pages 242-251 (1964), and U.S. Pat. Nos. 3,655,394 and 1,413,748.

A typical example of a monodispersed emulsion used in the present invention is an emulsion wherein silver halide grains have an average grain diameter of 0.05 micron and at least 90 wt % thereof are within ±40% of the average grain diameter. An emulsion wherein the average grain diameter is 0.15 to 2 microns, and at least 95 wt % of the silver halide grains or at least 95% of the number of the silver halide grains are within the average grain diameter ±20% can be used. The methods of producing such an emulsion are disclosed in U.S. Pat. Nos. 3,574,628 and 3,655,394 and British Patent 1,413,748. Monodispersed emulsions as described in Japanese Patent Application (OPI) Nos. 8600/73, 39027/76, 83097/76, 137133/78, 48521/79, 99419/79, 37635/83 and 49938/83, etc., are preferably used.

Tabular grains whose aspect ratio is 5 or more (i.e., 5/1 or more) can be used in the present invention. Tabular grains can be easily prepared by the methods described by Guttoff in *Photographic Science and Engineering*, Vol. 14, pages 248-257 (1970) and in U.S. Pat. Nos. 4,434,226, 4,414,310, 4,433,048 and 4,439,520, British Patent 2,112,157, etc. When tabular grains are used, there are such advantages that the covering power is increased and the color sensitization efficiency by a sensitizing dye is increased, which is described in detail in U.S. Pat. No. 4,434,262 cited above.

Grains wherein the form of crystals is controlled by using a sensitizing dye or a certain additive during the formation of grains can be used.

The crystal structure may be uniform, or the outer halogen composition may be different from the inner halogen composition, or the crystal structure may be a layer structure. These emulsion grains are disclosed in British Patent 1,027,146, U.S. Pat. Nos. 3,505,068 and 4,444,877, Japanese Patent Application (OPI) No. 248469/83, etc. Silver halides whose compositions are different may be joined by an epitaxial joint or a silver halide may be joined, for example, to a compound other than silver halides such as silver rhodan, lead oxide, etc. Such emulsion grains are disclosed in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, Japanese Patent Application (OPI) No. 162540/84, etc.

The so-called inner latent image type grain structure can be used that is obtained such that after the surface of the crystals is chemically ripened to form sensitivity specks ($Ag_2S$, $Ag_n$, Au, etc.), silver halide is grown around it.

In the step of forming or physically ripening silver halide grains, a cadmium salt, a zinc salt, a thallium salt, an iridium salt or a complex salt thereof, a rhodium salt or a complex salt thereof, an iron salt or a complex salt thereof, or the like may also be present.

These emulsions may be of a surface latent image type that forms a latent image mainly on the surface, or of a inner latent image type that forms a latent image in the grains.

Further, a direct reversal emulsion may be used. The direct reversal emulsion may be of a solarization type, of a inner latent image type, of a light-fogging type, of a nucleator-using type, or of a like type, and may be combined.

To remove the soluble silver salt from the emulsion before or after the physical ripening, the noodle washing method, the flocculation settling method, the ultrafiltration method, or the like can be used.

Generally, the emulsion to be used in the present invention should have been physically and/or chemically and/or spectrally ripened. Additives that will be used in this stage are described in *Research Disclosure*, RD No. 17643 (December, 1978) and RD No. 18716 (November, 1979), and the involved sections are indicated in the Table below.

Known photographic additives that can be used in the present invention are also described in RD Nos. 17643 and 18716, and the involved sections are also indicated in the Table below.

| Additive | RD 17643 | RD 18716 |
|---|---|---|
| 1. Chemical sensitizers | Page 23 | Page 648, right column |
| 2. Sensitivity increasers | | Page 648, right column |
| 3. Spectral sensitizers and supersensitizers | Pages 23 and 24 | Page 648, right column to page 649, right column |
| 4. Brightening agents | Page 24 | |
| 5. Fogging agents and | Pages 24 and 25 | Page 649, right |

-continued

| Additive | RD 17643 | RD 18716 |
|---|---|---|
| stabilizers | | column |
| 6. Light absorbers and filter dye ultraviolet absorbers | Pages 25 and 26 | Page 649, right column to page 650, left column |
| 7. Stain preventative agents | Page 25, right column | Page 650, left column to light column |
| 8. Dye image stabilizers | Page 25 | |
| 9. Hardeners | Page 26 | Page 651, left column |
| 10. Binders | Page 26 | Page 651, left column |
| 11. Plasticizers and lubricants | Page 27 | Page 650, right column |
| 12. Application aids and surface active agents | Pages 26 and 27 | Page 650, right column |
| 13. Antistatic agents | Page 27 | Page 650, right column |

Various color couplers can be used in the present invention, and examples thereof are described in patents disclosed in *Research Disclosure*, RD No. 17643, VII-C-G. As dye forming couplers, couplers capable of developing primary colors of the subtractive color process (i.e., yellow, magenta and cyan) are important, examples of hydrophobic 4-equivalent or 2-equivalent couplers that have been made nondiffusible are couplers disclosed in patents cited in *Research Disclosure*, RD No. 17643, VII-C and VII-D and in addition thereto the following couplers can be used favorably in the present invention.

Typical examples of yellow couplers that can be used in the present invention include hydrophobic acylacetamide type couplers having a ballast group. Examples thereof are described in U.S. Pat. Nos. 2,407,210, 2,875,057 and 3,265,506, etc. In the present invention, the use of 2-equivalent yellow couplers is preferred, and examples thereof are oxygen atom cleavable type yellow couplers described in U.S. Pat. Nos. 3,408,194, 3,447,928, 3,933,501 and 4,022,620, etc., or nitrogen atom cleavable type yellow couplers described in Japanese Patent Publication No. 10739/83, U.S. Pat. Nos. 4,401,752 and 4,326,024, *Research Disclosure*, RD No. 18053 (April, 1979), British Patent 1,425,020, German Offenlegungsschriften 2,219,917, 2,261,361, 2,329,587 and 2,433,812, etc. Particularly, α-pivaloylacetanilide type couplers are desirable because the fastness of the developed dye, particularly the fastness to light and developed hue are excellent.

Examples of magenta couplers that can be used in the present invention include, in addition to those represented by formula (I), hydrophobic indazolone type or cyanoacetyl types, preferably 5-pyrazolone type couplers having a ballast group. Of 5-pyrazolone type couplers, couplers wherein the 3-position is substituted by an arylamino group or an acylamino group are preferred with respect to the developed color density and the hue of the developed color dye, and typical examples thereof are described in U.S. Pat. Nos. 2,311,082, 2,343,703, 2,600,788, 2,908,573, 3,062,653, 3,152,896, 3,936,015, etc. As split-off groups of 2-equivalent 5-pyrazolone type couplers, nitrogen atom split-off groups described in U.S. Pat. No. 4,310,619 and arylthio groups described in U.S. Pat. No. 4,351,897 are particularly preferred. 5-Pyrazolone type couplers having a ballast group described in European Patent 73,636 provide a high developed color density.

Cyan couplers that can be used in the present invention include hydrophobic nondiffusion naphthol type and phenol type couplers, and typical examples thereof are naphthol type couplers described in U.S. Pat. No. 2,474,293, and preferably oxygen atom split-off type 2-equivalent naphthol type couplers described in U.S. Pat. Nos. 4,052,212, 4,146,396, 4,228,233 and 4,296,200. Examples of phenol type couplers are described in U.S. Pat. Nos. 2,369,929, 2,801,171, 2,772,162 and 2,895,826.

Cyan couplers fast to humidity and temperature are preferably used in the present invention, and typical examples thereof are phenol type cyan couplers having an alkyl group higher than an ethyl group in the meta-position of the phenol nucleus, 2,5-diacylamino-substituted phenol type couplers described in U.S. Pat. Nos. 2,772,162, 3,758,308, 4,126,396, 4,334,011 and 4,327,173, German Offenlegungsschrift 3,329,729, European Patent 121,365, etc., phenolic type couplers having a phenylureido group in the 2-position and an acylamino group in the 5-position and others described in U.S. Pat. Nos. 3,446,622, 4,333,999, 4,451,559, 4,427,767, etc.

Dye forming couplers may form a dimer or more higher polymers. Typical examples of dye forming couplers that have been polymerized are described in U.S. Pat. Nos. 3,451,820 and 4,080,211. Examples of polymerized magenta couplers are described in British Patent 2,102,173 and U.S. Pat. Nos. 2,102,173 and 4,367,282.

Couplers that can be used in the present invention can be introduced into a photographic material by any one of various known dispersing methods, for example, typically by the solid dispersing method, the alkali dispersing method, preferably the latex dispersing method, and more preferably the oil-in-water dispersion method. In the oil-in-water dispersing method, after the coupler is dissolved in one or a combination of a high boiling point organic solvent having a boiling point of 175° C. or over and a low boiling point so-called co-solvent, the mixture is dispersed finely into an aqueous solvent such as an aqueous gelatin solution in the presence of a surface active agent. Examples of the high boiling point organic solvents are described in U.S. Pat. No. 2,322,027, etc. The dispersing may be accompanied by phase reversal of emulsion, and, if required, the co-solvent is removed or decreased by distillation, noodle washing, ultrafiltration, or the like followed by application.

The process of the latex dispersion method, the effect thereof and examples of latexes for impregnation are described in U.S. Pat. No. 4,199,636, German Offenlegungsschriften 2,541,274 and 2,541,230.

Photographic materials that will be produced using the present invention may contain, as a color anti-foggant or a color mixing preventive agent, hydroquinone derivatives, aminophenol derivatives, amines, gallic acid derivatives, pyrocatechol derivatives, ascorbic acid derivatives, colorless couplers, sulfonamidophenol derivatives, etc.

The present photographic material can use various discoloration preventive agents. Typical examples of organic discoloration preventive agents are hydroquinone derivatives, 6-hydroxycumarones, 5-hydroxycumarones, spirocumarones, p-alkoxyphenols, hindered phenols including bisphenols, gallic acid derivatives, methylenedioxybenzenes, aminophenols, hindered amines, and ether or ester derivatives obtained by silylating or alkylating the phenolic hydroxyl group of these compounds. Metal complexes such as (bissalicylaldoxymato)nickel complex and (bis-N,N-dialkyldithiocarbamato)nickel complexes can also be used.

The present invention can be applied to a multilayer multicolor photographic material having at least two different spectral sensitivities on a support. Generally a multilayer color photographic material has at least one red-sensitive emulsion layer, at least one green-sensitive emulsion layer and at least one blue-sensitive emulsion layer on a support.

It is preferred that the present photographic material have, in addition to a silver halide emulsion layer auxiliary layers suitably such as a protective layer, an intermediate layer, a filter layer, an anti-halation layer, a back layer, and the like.

In the present photographic material, the photographic emulsion layer and other layers are applied on a flexible support that is usually used for a photographic material such as plastic film, paper or cloth, or a rigid support such as glass, earthenware and metals. Useful flexible supports include films of cellulose derivatives (cellulose nitrate, cellulose acetate, cellulose acetate butyrate, etc.), synthetic polymers (polystyrenes, polyvinyl chlorides, polyethylene terephthalates, polycarbonates, etc.), paper on which a baryta layer, α-olefin polymers (e.g., polyethylenes, polypropylenes, and ethylene/butene copolymers) or the like is applied or laminated. The support may be colored using a dye or a pigment. The support may be blackened for the purpose of screening light. The surface of the support is generally primed so that the adhesion thereof to a photographic emulsion layer or the like may be made favorable. Before or after a primer is applied, the surface of the support may be treated with glow discharge, corona discharge, ultraviolet irradiation, flame treatment, or the like.

As a method of applying a photographic layer and other hydrophilic colloid layers, a known method can be used, for example, a dip coating method, a roller coating method, a curtain coating method, an extrusion coating method, etc. If required, a plurality of layers may be applied simultaneously by the methods described in U.S. Pat. Nos. 2,681,294, 2,761,791, 3,526,528, 3,508,947, etc.

The color photographic material according to the present invention can be developed by conventional methods, such as those described in *Research Disclosure*, RD No. 17643 (December, 1978), pages 28–29, and RD No. 18716 (November, 1979), page 651, from the left column to the right column. Generally, the present color photographic material is subjected to water washing treatment or stabilizing treatment after the development and the bleach-fix or fixing treatment.

That is, the present photographic material can be subjected to color negative treatment that is made up of development, bleach, fixing, stabilizing bath, etc., or color reversal treatment that is made up of black-and white development, reversing, color development, bleach, fixing, stabilizing bath, etc. In particular, in a color reversal treatment, desirably the black-and-white development bath uses a developing agent made up of a hydroquinone derivative and a phenidone derivative and desirably uses a silver halide solvent such as a rhodan salt and a sulfite. In the reversal step, a fogging agent such as a tin salt may be used, and reversal may be effected by irradiation with light. The bleaching bath and the fixing bath may be a combined bleaching and fixing bath and a stabilizing bath may be excluded. It is preferred that a washing bath (including a rinsing bath wherein the amount of water saved is more than in the usual washing bath) is provided between processing steps.

The washing step generally uses more than one tank, and counterflow washing is used to save water. As a stabilizing treatment, instead of a washing step, a multistage counterflow stabilizing treatment as described in Japanese Patent Application (OPI) No. 8543/82 is one exemplification, and in this step, 2 to 9 counterflow tanks are required. In this stabilizing bath, various compounds are added to stabilize the image. Various buffers for adjusting, for example, the film pH (for example, 3 to 8) can be exemplified. If required, various additives, for example, a water softening agent (e.g., aminocarboxylic acids, organic phosphoric acids, aminopolyphosphoric acids, phosphonocarboxylic acids, etc.), a fungicide (e.g., benzothiazolinones, isothiazolones, 4-thiazolinebenzimidazoles, halogenated phenols, etc.), a surface active agent, a brightening agent, a hardening agent, etc., can be used, and these additives may be combined for the same purpose of different purposes.

It is preferable that various ammonium salts are added as a film pH adjusting agent after the treatment.

The present invention can be applied to various color photographic materials. Typical examples thereof are color negative films for general purpose and for movie, color reversal films for slides or television, color papers, color positive films, color reversal papers, etc. The present invention can also be applied to black-and-white photographic materials that use a three-coupler mix described in *Research Disclosure*, RD No. 17123 (June, 1978).

The present invention is now described in more detail with reference to the following examples.

EXAMPLE 1

A photosensitive layer made up of the following first to seventh layers was applied to a paper support whose opposite surfaces were laminated with polyethylene layers to prepare a silver halide color photographic material. The polyethylene layer adjacent to the first layer contained titanium dioxide and a trace amount of ultramarine blue.

Constitution of the Photosensitive Layer

The number corresponding to each component indicates the applied amount in g/m$^2$, and, with respect to the silver halide, the applied amount is stated in terms of the silver content.

| | |
|---|---|
| The First Layer: Blue-Sensitive Emulsion Layer | |
| Silver chlorobromide emulsion (silver bromide: 80 mol %) | 0.30 (silver) |
| Yellow coupler (*1) | 0.70 |
| Yellow coupler solvent (TNP) | 0.15 |
| Gelatin | 1.20 |
| The Second Layer: Intermediate Layer | |
| Gelatin | 0.90 |
| Di-t-octylhydroquinone | 0.05 |
| Di-t-octylhydroquinone solvent (DBP) | 0.10 |
| The Third Layer: Green-Sensitive Emulsion Layer | |
| Silver chlorobromide emulsion (silver bromide: 70 mol %) | 0.45 (silver) |
| Magenta coupler (*2) | 0.35 |
| Magenta coupler solvent (TOP) | 0.44 |
| Discoloration preventive agent (*3/*4) | 0.05/0.10 |
| Gelatin | 1.00 |
| The Fourth Layer: Ultraviolet Absorbable Intermediate Layer | |

-continued

| | |
|---|---|
| Ultraviolet absorbing agent (*5/*6/*7) | 0.06/0.25/0.25 |
| Ultraviolet absorbing agent solvent (TNP) | 0.20 |
| Di-t-octylhydroquinone | 0.05 |
| Di-t-octylhydroquinone solvent (DBP) | 0.10 |
| Gelatin | 1.50 |
| The Fifth Layer: Red-Sensitive Emulsion Layer | |
| Silver chlorobromide emulsion (silver bromide: 50 mol %) | 0.20 (silver) |
| Cyan coupler (*8/*9) | 0.20/0.20 |
| Cyan coupler solvent (TNP/DBP) | 0.10/0.20 |
| Gelatin | 0.90 |

-continued

| | |
|---|---|
| The Sixth Layer: Ultraviolet Absorbable Intermediate Layer | |
| Ultraviolet absorbing agent (*5/*6/*7) | 0.06/0.25/0.25 |
| Ultraviolet absorbing agent solvent (DBP) | 0.20 |
| Gelatin | 1.50 |
| The Seventh Layer: Protective Layer | |
| Gelatin | 1.50 |

In the above, DBP stands for dibutyl phthalate, TOP stands for tri-n-octyl phosphate, and TNP stands for tri-n-nonyl phosphate.

(*1)

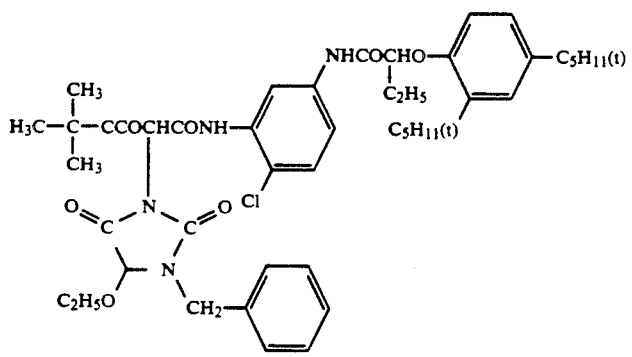

(*2)

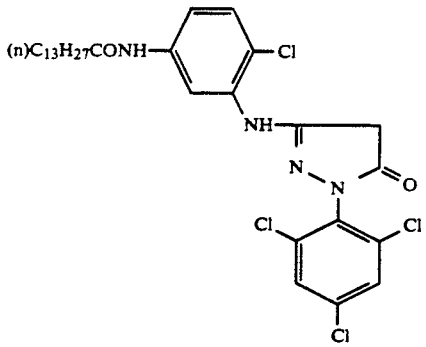

(*3)

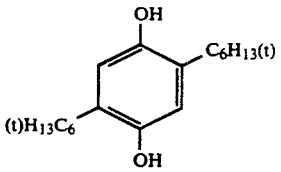

(*4)

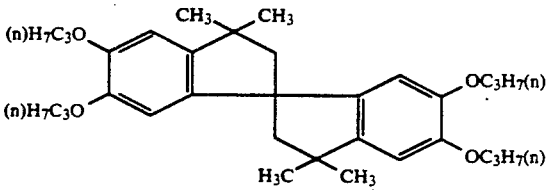

(*5)

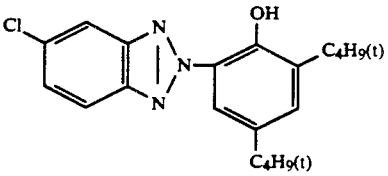

-continued (*6)

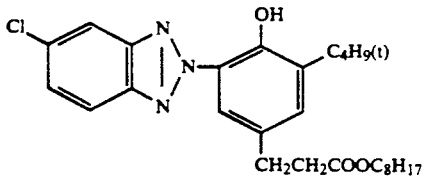

(*7)

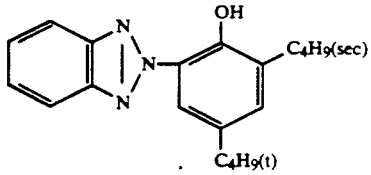

(*8)

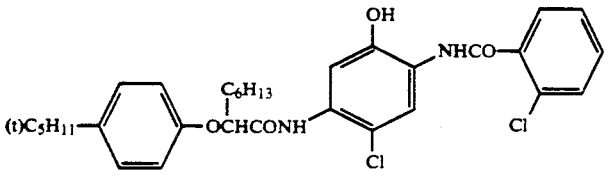

(*9)

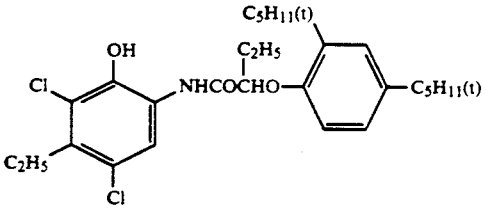

As spectral sensitizing agents for the emulsion layers, the following dyes were used.

Blue-Sensitive Emulsion Layer:

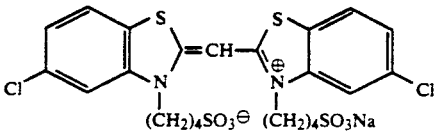

(An amount of $2\times10^{-4}$ mol per mol of silver halide was added.)

Green-Sensitive Emulsion Layer:

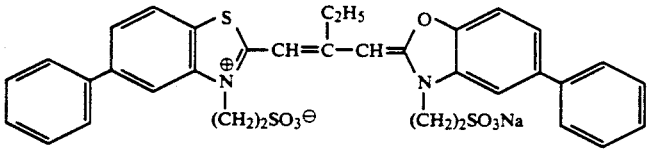

(An amount of $2.5\times10^{-4}$ mol per mol of silver halide was added.)

Red-Sensitive Emulsion Layer:

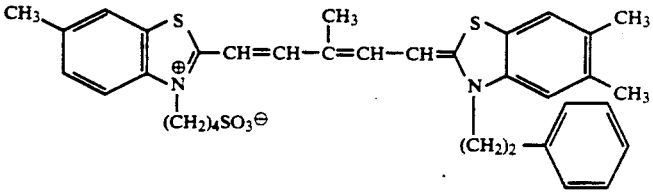

(An amount of $2.5\times10^{-4}$ mol per mol of silver halide was added.)

As irradiation preventive dyes for the emulsion layers, the following dyes were used.

Green-Sensitive Emulsion Layer:

-continued

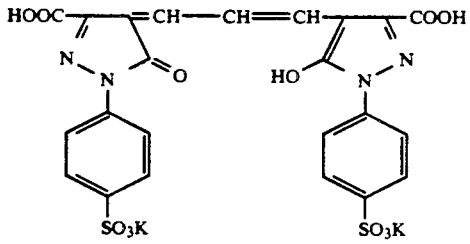

Red-Sensitive Emulsion Layer:

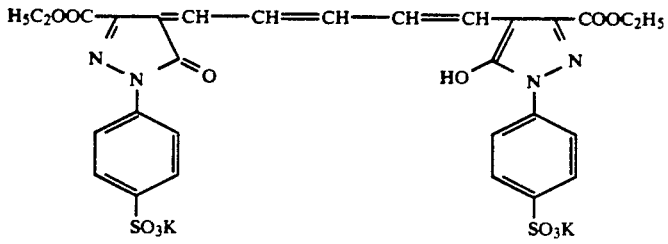

This silver halide color photographic material was named Sample 101.

Samples 102 to 110 were prepared in the same way for Sample 101, except changes as shown in Table 1. These Samples were subjected to step exposure for sensitometry using an enlarger (Fuji Color Head 609, manufactured by Fuji Photo Film Co., Ltd.), and were developed in the steps shown below. The results are set forth in Table 1.

After the above photosensitive materials had been exposed through an optical wedge, they were treated in the following step.

| Treating Step | Temperature (°C.) | Time (sec) |
|---|---|---|
| Color Development | 35 | 60 |
| Bleach-Fix | 35 | 60 |
| Washing | 24–35 | 60 |
| Drying | 80 | 60 |

The compositions of the treating liquids were as follows.

| | |
|---|---|
| Color Developing Solution: | |
| Water | 800 ml |
| Diethylenetriaminepentaacetic Acid | 3.0 g |
| Sodium Sulfite | 2.0 g |
| Potassium Bromide | 0.5 g |
| Potassium Carbonate | 30.0 g |
| N-Ethyl-N-(β-methanesulfonamidoethyl)-3-methyl-4-aminoaniline | 5.0 g |
| Hydroxylamine Sulfate | 4.0 g |
| Brightening Agent (4,4'-distilbene type) | 1.0 g |
| Water to make | 1 liter |
| pH (25° C.) | 11.0 |
| Bleach-Fix Bath: | |
| Water | 400 ml |
| Ammonium Thiosulfate (70% solution) | 150 ml |
| Sodium Sulfite | 18 g |
| Iron (III) Ethylenediaminetetraacetate | 55 g |
| Ammonium Ethylenediaminetetraacetic Acid.2Na | 5 g |
| Water to make | 1,000 ml |
| pH (25° C.) | 6.70 |

TABLE 1

| Sample No. | Example | Coupler Compound | Coupler Amount (g/m²) | Discoloration Preventive Agent/Stain Preventive Agent Compound | Discoloration Preventive Agent/Stain Preventive Agent Amount (g/m²) | Magenta Stain (the magenta stain of Sample 101 was assumed to be 0.0) | Color Purity $[(D_R + D_B)/D_G]$ | Dye Stability |
|---|---|---|---|---|---|---|---|---|
| 101 | Comparison | *2 | 0.35 | *3 | 0.05 | 0.00 | 0.473 | 0.86 |
| | | | | *4 | 0.10 | | | |
| 102 | " | " | " | *4 | 0.15 | 0.05 | 0.473 | 0.82 |
| 103 | " | M-5* | 0.30 | — | — | 0.08 | 0.182 | 0.60 |
| 104 | " | " | " | *3 | 0.15 | 0.00 | 0.184 | 0.49 |
| 105 | " | " | " | *10 | 0.15 | 0.00 | 0.185 | 0.45 |
| 106 | " | " | " | *3 | 0.05 | 0.00 | 0.183 | 0.59 |
| | | | | *4 | 0.10 | | | |
| 107 | " | " | " | *3 | 0.01 | 0.03 | 0.183 | 0.67 |
| | | | | *4 | 0.10 | | | |
| 108 | Invention | " | " | II-5 | 0.01 | 0.00 | 0.182 | 0.84 |
| | | | | *4 | 0.10 | | | |
| 109 | " | " | " | II-2 | 0.02 | 0.00 | 0.182 | 0.82 |
| | | | | *4 | 0.10 | | | |
| 110 | " | M-41* | " | II-2 | 0.01 | 0.00 | 0.177 | 0.87 |
| | | | | *11 | 0.20 | | | |
| 111 | Comparison | M-5 | " | — | — | 0.16 | 0.183 | 0.61 |

TABLE 1-continued

| Sample No. | Example | Coupler Compound | Coupler Amount (g/m²) | Discoloration Preventive Agent/ Stain Preventive Agent Compound | Discoloration Preventive Agent/ Stain Preventive Agent Amount (g/m²) | Magenta Stain (the magenta stain of Sample 101 was assumed to be 0.0) | Color Purity $[(D_R + D_B)/D_G]$ | Dye Stability |
|---|---|---|---|---|---|---|---|---|
| 112 | Comparison | M-5 | 0.30 | *3 | 0.05 | 0.03 | 0.183 | 0.68 |
| | | | | *4 | 0.10 | | | |
| 113 | Invention | " | " | II-2 | 0.02 | 0.00 | 0.182 | 0.83 |
| | | | | *4 | 0.10 | | | |

*The applied amount of silver was 50% (0.23 g/m²)

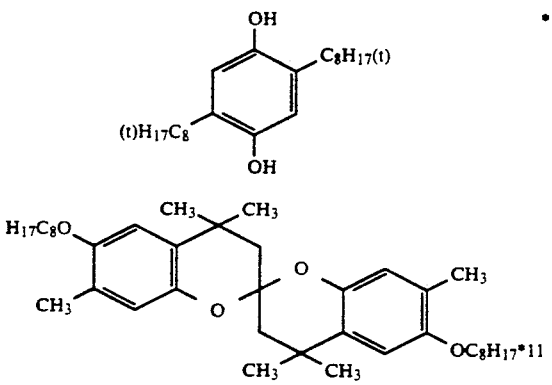

*10

The results of Samples 111 to 113 in Table 1 were obtained by using Samples 103, 107 and 109 and adding 0.05 g of potassium rhodan/liter to the color developing solution in the treating steps.

Color purity in Table 1 is the value obtained from the values of $D_B$ and $D_R$ at the magenta deysity $(D_G)=1.0$ when exposed by an optical wedge of a green filter, based on the formula $(D_B+D_R)/D_G$; the smaller the value, the better the color purity.

The value of the magenta stain is obtained by measuring the magenta density of the unexposed section (white section) and comparing it with the value of Sample 101; the smaller the value, the better the whiteness.

The value of dye image fastness indicates the value of $D_G$ after discoloring a point where the density is $D_G=1.0$ by a xenon incubator (irradiated with 100,000 lux for 120 hours); the higher the value, the better the fastness.

As can be understood from Table 1, Samples 108, 109, 110 and 113 are high in color purity, and their color is brilliant, they are free from magenta stain, and their dye fastness is good. In samples that used hydroquinone derivatives (*3) and (*10), which are not in accordance with the present invention, although the magenta stain was decreased, fastness to light worsened.

EXAMPLE 2

The following first to eleventh layers were applied successively to a paper support whose opposite surfaces were laminated with polyethylene layers to prepare a silver halide color photographic material. The polyethylene adjacent to the first layer contained titanium white as a white pigment and a trace amount of ultramarine blue as a bluish dye.

Constitution of the Photosensitive Layer

The following are components and applied amounts in g/m², and with respect to the silver halide, the applied amount is stated in terms of the silver content.

| | |
|---|---|
| The First Layer: Antihalation Layer | |
| Black colloid silver | 0.10 |
| Gelatin | 2.0 |
| The Second Layer: Low Sensitivity Red-Sensitive Layer | |
| Silver bromoiodide emulsion (silver bromide: 3.5 mol %; average grain size: 0.7 μm) spectrally sensitized with red sensitizing dyes (*5 and *4) | 0.15 (silver) |
| Gelatin | 1.0 |
| Cyan coupler (*3) | 0.30 |
| Discoloration preventive agent (*2) | 0.15 |
| Coupler solvent (*18 and *1) | 0.06 |
| The Third Layer: High Sensitivity Red-Sensitivity Layer | |
| Silver bromoiodide emulsion (silver bromide: 8.0 mol %; average grain size: 0.7 μm) spectrally sensitized with red sensitizing dyes (*5 and *4) | 0.10 (silver) |
| Gelatin | 0.50 |
| Cyan coupler (*3) | 0.10 |
| Discoloration preventive agent (*2) | 0.05 |
| Coupler solvent (*18 and *1) | 0.02 |
| The Fourth Layer: Intermediate Layer | |
| Yellow colloid silver | 0.02 |
| Gelatin | 1.00 |
| Color mixing preventive agent (*14) | 0.08 |
| Color mixing preventive agent solvent (*13) | 0.16 |
| Polymer latex (*6) | 0.10 |
| The Fifth Layer: Low Sensitivity Green-Sensitive Layer | |
| Silver bromoiodide emulsion (silver bromide: 2.5 mol %; average grain size: 0.4 μm) spectrally sensitized with a green sensitizing dye (*12) | 0.20 (silver) |
| Gelatin | 0.70 |
| Magenta coupler (*11) | 0.40 |
| Discoloration preventive agent A (*10) | 0.05 |
| Discoloration preventive agent B (*9) | 0.05 |
| Discoloration preventive agent C (*8) | 0.02 |
| Coupler solvent (*7) | 0.15 |
| The Sixth Layer: High Sensitivity Green-Sensitive Layer | |
| Silver bromoiodide emulsion (silver bromide: 3.5 mol %; average grain size: 0.9 μm) spectrally sensitized with a green sensitizing dye (*12) | 0.20 (silver) |
| Gelatin | 0.70 |
| Magenta coupler (*11) | 0.40 |
| Discoloration preventive agent A (*10) | 0.05 |
| Discoloration preventive agent B (*9) | 0.05 |
| Discoloration preventive agent C (*8) | 0.02 |
| Coupler solvent (*7) | 0.15 |
| The Seventh Layer: Yellow Filter Layer | |
| Yellow colloid silver | 0.20 |
| Gelatin | 1.00 |

-continued

| | |
|---|---|
| Color mixing preventive agent (*14) | 0.06 |
| Color mixing preventive agent solvent (*13) | 0.24 |
| Irradiation preventive dye (*23) | 0.025 |
| Irradiation preventive dye (*24) | 0.020 |
| The Eighth Layer: Low Sensitive Blue-Sensitive Layer | |
| Silver bromoiodide emulsion (silver bromide: 2.5 mol %; average grain size: 0.5 μm) spectrally sensitized with a blue sensitizing dye (*16) | 0.15 (silver) |
| Gelatin | 0.50 |
| Yellow coupler (*15) | 0.20 |
| Coupler solvent (*18) | 0.05 |
| The Ninth Layer: High Sensitivity Blue-Sensitive Layer | |
| Silver bromoiodide emulsion (silver bromide: 2.5 mol %; average grain size: 1.4 μm) spectrally sensitized with a blue sensitizing dye (*16) | 0.20 (silver) |
| Gelatin | 0.50 |
| Yellow coupler (*15) | 0.20 |
| Coupler solvent (*18) | 0.05 |
| The Tenth Layer: Ultraviolet Absorbing Layer | |
| Gelatin | 1.50 |
| Ultraviolet absorbing agent (*19) | 1.0 |
| Ultraviolet absorbing agent (*18) | 0.30 |
| Color mixing preventive agent (*17) | 0.08 |
| The Eleventh Layer: Protective Layer | |
| Finely divided silver chlorobromide (silver chloride: 77 mol %; average grain diameter: 0.2 μm) | 0.07 |
| Gelatin | 1.0 |

-continued

| | |
|---|---|
| Hardening agent (*20) | 0.17 |

(*1) Dioctyl phthalate
(*2) 2-(2-Hydroxy-3-sec-butyl-5-t-butylphenyl)benzoatetriazole
(*3) 2-[α-(2,4-di-t-amylphenoxy)butanamido]-4,6-dichloro-5-methylphenol
(*4) 5,5'-Dichloro-3,3'-di(3-sulfobutyl)-9-ethylthiacarbonylcyanine Na salt
(*5) Triethylammonium-3-[2-{2-[3-(3-sulfopropyl)-naphtho[1,2-d]thiazolin-2-iridenemethyl]-1-butenyl}-3-naphtho[1,2-d]thiazolino]propane-sulfonate
(*6) Polyethyl acrylate
(*7) Phosphoric acid trioctylester
(*8) 2,5-Di-t-hexylhydroquinone
(*9) Di(2-hydroxy-3-t-butyl-5-methylphenyl)methane
(*10) 3,3,3',3'-tetramethyl-5,6,5',6'-tetrapropoxy-1,1'-bisspiroindane
(*11) 1-(2,4,6-Trichlorophenyl)-3-(2-chloro-5-tetra-decanamido)anilino-2-pyrazolin-5-one
(*12) 5,5'-diphenyl-9-ethyl-3,3'-disulfopropyloxa-carboxyaniline sodium salt
(*13) Phosphoric acid o-cresylester
(*14) 2,5-Di-t-octylhydroquinone
(*15) α-Pivaloyl-α-[(2,4-dioxo-1-benzyl-5-ethoxy-hydantoin-3-yl)-2-chloro-5-(α-2,4-dioxo-t-amyl-phenoxy)butanamido]acetanilide
(*16) Triethylammonium 3-[2-(3-benzylrhodanin-5-tridene)-3-benzoxozalinyl]propanesulfonate
(*17) 2,5-Di-sec-octylhydroquinone
(*18) Phosphoric acid trinonylester
(*19) 5-Chloro-2-(2-hydroxy-3-t-butyl-5-t-octyl)-phenylbenzotriazole
(*20) 1,4-Bis(vinylsulfonylacetamido)ethane
(*21) 2-[α-(2,4-di-t-amylphenoxy)butanamido]-4,6-dichloro-5-ethylphenol
(*22) 4-Chloro-2-(2-chlorobenzamido)-5-[α-(4-t-amyl-2-chlorophenoxy)octanamido]phenol

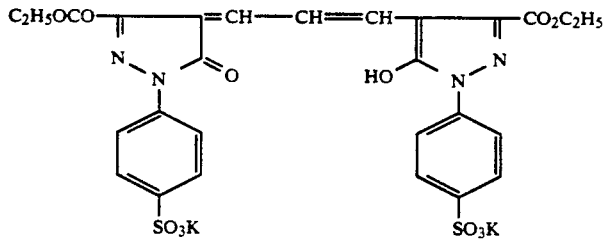

*23

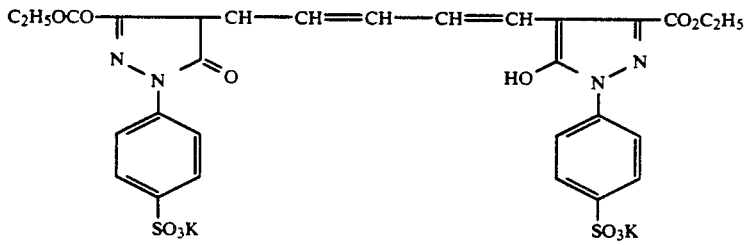

*24

The thus prepared samples were compared with comparative control sample.

Samples where magenta couplers and additives were changed as shown in Table 1 were named Samples 201 to 219.

These samples were subjected to step exposure using white light and yellow light for sensitometry, and developed in the following treatment steps.

The conditions and results are given in Table 2.

| Treatment Step | | |
|---|---|---|
| First Development (black-and-white development) | 38° C. | 1 min 15 sec |
| Washing | 38° C. | 1 min 30 sec |
| Reversing Exposure | 100 lux or over | 1 sec or over |
| Color Development | 38° C. | 2 min 15 sec |
| Washing | 38° C. | 45 sec |
| Bleach-Fix | 38° C. | 2 min 00 sec |
| Washing | 38° C. | 2 min 15 sec |

Treating Solution Composition

First Developing Solution:

| | |
|---|---|
| Nitrilo-N,N,N-trimethylenephosphonic Acid | 0.6 g |

-continued

| | |
|---|---|
| Pentasodium Salt | |
| Diethylenetriaminepentaacetic Acid Pentasodium Salt | 4.0 g |
| Potassium Sulfite | 30.0 g |
| Potassium Thiocyanate | 1.2 g |
| Potassium Carbonate | 35.0 g |
| Hydroquinonemonosulfonate Potassium Salt | 25.0 g |
| Diethylene Glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1 liter |
| pH | 9.70 |

-continued

| | |
|---|---|
| Water to make | 1 liter |
| pH | 10.40 |
| Bleach-Fix Bath: | |
| Ethylenediaminetetraacetic Acid Disodium Salt Dihydrate | 5.0 g |
| Ethylenediaminetetraacetic Acid Fe (III).Ammonium Monohydrate | 80.0 g |
| Sodium Sulfate | 15.0 g |
| Sodium Thiosulfate (700 g/liter soln.) | 160.0 g |
| Glacial Acetic Acid | 5.0 ml |
| Water to make | 1 liter |
| pH | 6.50 |

TABLE 2

| Sample No. | Example | Coupler (both 5th and 6th layers) Compound | Coupler Amount ($g/m^2$) | Discoloration Preventive Agent/ Stain Preventive Agent Compound | Amount ($g/m^2$) | Magenta Stain (the magenta stain of Sample 101 was assumed to be 0.0) | Color Purity $[(D_R + D_B)/D_G]$ | Dye Stability |
|---|---|---|---|---|---|---|---|---|
| 201 | Comparison | *11 | 0.40 | *8 | 0.02 | 0.00 | 0.476 | 0.90 |
| | | | | *9 | 0.05 | | | |
| | | | | *10 | 0.05 | | | |
| 202 | " | " | " | *9 | 0.05 | 0.04 | 0.474 | 0.83 |
| | | | | *10 | 0.05 | | | |
| 203 | " | " | " | *9 | 0.05 | 0.01 | 0.475 | 0.83 |
| | | | | *10 | 0.05 | | | |
| | | | | II-5 | 0.01 | | | |
| 204 | " | M-40* | 0.30 | — | — | 0.10 | 0.175 | 0.58 |
| 205 | " | " | " | *10 | 0.15 | 0.10 | 0.176 | 0.90 |
| 206 | " | " | " | *8 | 0.02 | 0.00 | 0.178 | 0.68 |
| | | | | *10 | 0.15 | | | |
| 207 | " | " | " | *8 | 0.005 | 0.01 | 0.175 | 0.79 |
| | | | | *10 | 0.15 | | | |
| 208 | Invention | " | " | II-5 | 0.005 | 0.00 | 0.176 | 0.88 |
| | | | | *10 | 0.15 | | | |
| 209 | " | " | " | II-2 | 0.005 | 0.00 | 0.175 | 0.91 |
| | | | | *10 | 0.15 | | | |
| 210 | Comparison | M-5* | 0.27 | — | — | 0.08 | 0.183 | 0.89 |
| | | | | *10 | 0.15 | | | |
| 211 | Invention | M-5* | 0.27 | II-2 | 0.01 | 0.00 | 0.182 | 0.89 |
| | | | | *10 | 0.15 | | | |
| 212 | Comparison | M-34* | 0.25 | — | — | 0.09 | 0.179 | 0.88 |
| | | | | *10 | 0.15 | | | |
| 213 | Invention | " | " | II-2 | 0.01 | 0.00 | 0.179 | 0.89 |
| | | | | *10 | 0.15 | | | |
| 214 | Comparison | M-26 | 0.25 | *8 | 0.005 | 0.02 | 0.175 | 0.76 |
| | | | | *10 | 0.15 | | | |
| 215 | Invention | " | " | II-5 | 0.005 | 0.00 | 0.175 | 0.89 |
| | | | | *10 | 0.15 | | | |
| 216 | Comparison | M-32 | 0.30 | — | — | 0.11 | 0.173 | 0.54 |
| 217 | Invention | " | " | II-2 | 0.005 | 0.01 | 0.173 | 0.90 |
| | | | | *10 | 0.15 | | | |
| 218 | Comparison | M-41 | 0.30 | *8 | 0.005 | 0.04 | 0.181 | 0.78 |
| | | | | *10 | 0.15 | | | |
| 219 | Invention | " | " | II-5 | 0.005 | 0.01 | 0.181 | 0.89 |
| | | | | *10 | 0.15 | | | |
| 220 | Comparison | M-40* | 0.30 | *8 | 0.005 | 0.02 | 0.175 | 0.76 |
| | | | | *10 | 0.15 | | | |
| 221 | Invention | M-40* | 0.30 | II-5 | 0.005 | 0.00 | 0.175 | 0.89 |
| | | | | *10 | 0.15 | | | |

*The applied amount of silver was reduced to 60%.

Color Developing Solution:

| | |
|---|---|
| Benzyl Alcohol | 15.0 ml |
| Diethylene Glycol | 12.0 ml |
| 3,6-Dithia-1,8-octanediol | 0.2 g |
| Nitrilo-N,N,N-trimethylenephosphonic Acid Pentasodium Salt | 0.5 g |
| Diethylenetriaminepentaacetic Acid Pentasodium Salt | 2.0 g |
| Sodium Sulfite | 2.0 g |
| Potassium Carbonate | 25.0 g |
| Hydroxylamine Sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |

The results of Samples 220 and 221 in Table 2 were obtained by using Samples 207 and 208, except that the thioether compound (3,6-dithia-1,8-octanediol: 0.2 g/liter) was removed from the color developing solution.

The definition of the values of the stability of the dye image and the color purity in Table 2 is the same as in Example 1. Magenta stain is the value when the value of the magenta density of the stain of the white section of the white exposed section was compared with Sample 201.

As can be understood from Table 2, Samples 208, 209, 211, 213, 215, 217 and 219 according to the present invention have high magenta color purities, are free from color fog (magenta stain) due to treatment, and are good in dye stability. It can be understood that samples using a long chain alkyl hydroquinone (*8), which are not according to the present invention, have an effect for preventing color fog, but the light resistance of the magenta image is spoiled. It can also be understood that this phenomenon is high when the color developing solution contains a thioether type compound (compare Samples 207 and 220 with Samples 208 and 221), respectively.

While the invention has been described in detail and with reference to specific embodiments thereof, it will be apparent to one skilled in the art that various changes and modifications can be made therein without departing from the spirit and scope thereof.

What is claimed is:

1. A process for developing an imagewise exposed silver halide color photographic material comprising at least one pyrazoloazole magenta coupler represented by formula (Ic) or (Id)

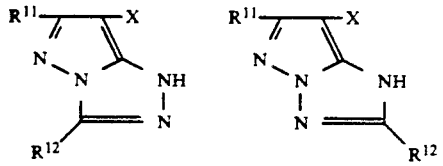

(Ic) (Id)

wherein $R^{11}$ $R^{12}$ each represents a hydrogen atom, a halogen atom, an alkyl group, an aryl group, a heterocyclic group, a cyano group, an alkoxy group, an aryloxy group, a heterocyclic hydroxyl group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X represents a hydrogen atom, a halogen atom, a carboxyl group, or a group that is joined to the carbon atom at the coupling position via an oxygen atom, a nitrogen atom, or a sulfur atom, and is cleavable when coupling occurs; or $R^{11}$, $R^{12}$, or X represents a divalent group forming a bis form compound; or $R^{11}$, or $R^{12}$ or X represents a vinyl group or other linking group; and at least one compound represented by formula (II)

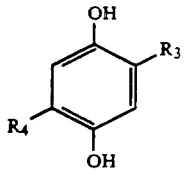

(II)

wherein $R_3$ represents an octyl group and $R_4$ represents a hydrogen atom or a methyl group wherein said imagewise exposed silver halide color photographic material is developed with a color developing solution comprising a rhodan salt or an organic thio ether compound, wherein the rhodan salt or organic thio ether compound is present in an amount of 0.01 to 3 g/l.

2. A process for developing an imagewise exposed silver halide color photographic material as in claim 1, wherein the coupler represented by formula (Ic) or (Id) is contained in a green-sensitive layer in the amount of from 0.01 $g/m^2$ to 1.0 $g/m^2$.

3. A process for developing an imagewise exposed silver halide color photographic material as in claim 1, wherein the compound represented by formula (II) is contained in the same layer as the pyrazoloazole coupler represented by formula (Ic) or (Id) and is present in an amount of from 1 mol % to 10 mol % with respect to the coupler.

4. A process for developing an imagewise exposed silver halide color photographic material as in claim 1, wherein the rhodan salt is selected from the group consisting of (III-1): KSCN, (III-2): NaSCN, and (III-3): $NH_4SCN$.

5. A process for developing an imagewise exposed silver halide color photographic material as in claim 1, wherein the organic thio ether compound is selected from the group consisting of $$HO\text{-}(R_{41}\text{-}S)_n\text{-}R_{41}OH, \quad \text{(IVa)}$$

$$(HO\text{-}R_{41}\text{-}SR_{41}\text{-}OR_{42})_2O, \quad \text{(IVb)}$$

or

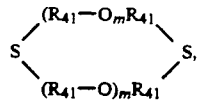

(IVc)

wherein m and n each is an integer of 1 to 3, and $R_{41}$ and $R_{42}$ each represents an alkylene group containing from 1 to 5 carbon atoms.

6. A process for developing an imagewise exposed silver halide color photographic material as in claim 4, wherein the color developing solution contains said rhodan salt.

7. A process for developing an imagewise exposed silver halide color photographic material as in claim 5, wherein the color developing solution contains said organic thio ether compound.

8. A process for developing an imagewise exposed silver halide color photographic material as in claim 1, wherein said pyrazoloazole coupler represented by formula (Ic) or (Id) is selected from the group of pyrazoloazole magenta couplers represented by formula (Id).

* * * * *